US009629224B2

(12) United States Patent
Dai et al.

(10) Patent No.: US 9,629,224 B2
(45) Date of Patent: Apr. 18, 2017

(54) LIGHTING DEVICE

(75) Inventors: Xuewei Dai, Guangdong (CN); Aimin Lin, Guangdong (CN); Middel Tjaco, Shenzhen (CN); Zesheng Ye, Shenzhen (CN)

(73) Assignee: OSRAM GMBH, Munich (DE)

( * ) Notice: Subject to any disclaimer, the term of this patent is extended or adjusted under 35 U.S.C. 154(b) by 0 days.

(21) Appl. No.: 14/344,920

(22) PCT Filed: Aug. 14, 2012

(86) PCT No.: PCT/EP2012/065900

§ 371 (c)(1),
(2), (4) Date: May 15, 2014

(87) PCT Pub. No.: WO2013/037585

PCT Pub. Date: Mar. 21, 2013

(65) Prior Publication Data

US 2014/0375204 A1 Dec. 25, 2014

(30) Foreign Application Priority Data

Sep. 15, 2011 (CN) ..... 2011 1 0273883

(51) Int. Cl.
*H05B 41/36* (2006.01)
*H05B 37/02* (2006.01)
(Continued)

(52) U.S. Cl.
CPC ..... *H05B 37/0272* (2013.01); *F21K 9/00* (2013.01); *F21V 23/004* (2013.01); *F21V 29/70* (2015.01);
(Continued)

(58) Field of Classification Search
CPC ... H05B 37/0272; F21V 23/004; F21V 29/22; F21K 9/00
(Continued)

(56) References Cited

U.S. PATENT DOCUMENTS 6,784,620 B1 * 8/2004 Peters ..... 315/111.21
7,218,056 B1 * 5/2007 Harwood ..... 315/86
(Continued)

FOREIGN PATENT DOCUMENTS

CN 201127136 Y 10/2008
CN 201412698 Y 2/2010
WO 2010140136 A1 12/2010

OTHER PUBLICATIONS

International Search Report issued in the corresponding PCT application No. PCT/EP2012/065900, dated Oct. 18, 2012.
(Continued)

*Primary Examiner* — Douglas W Owens
*Assistant Examiner* — Wei Chan
(74) *Attorney, Agent, or Firm* — Viering, Jentschura & Partner mbB

(57) ABSTRACT

A lighting device may include a tube and end caps located at two ends of the tube, a lighting assembly arranged in the tube, a driver for the lighting assembly, an antenna, and a wireless communication circuit for conducting wireless communication, the antenna being provided in the end cap and the wireless communication circuit being provided in the tube or at least partially provided in the end cap, and one side of the wire communication circuit being connected to the driver and the other side thereof being connected to the antenna.

9 Claims, 2 Drawing Sheets

(51) Int. Cl.

| | |
|---|---|
| ***F21S 4/00*** | (2016.01) |
| ***H05B 33/08*** | (2006.01) |
| ***F21K 9/00*** | (2016.01) |
| ***F21V 23/00*** | (2015.01) |
| ***F21V 29/70*** | (2015.01) |
| *F21Y 101/00* | (2016.01) |

(52) U.S. Cl.
CPC ..... *H05B 33/0803* (2013.01); *H05B 33/0815* (2013.01); *H05B 33/0845* (2013.01); *F21Y 2101/00* (2013.01)

(58) Field of Classification Search
USPC ..... 700/276, 297; 340/815.45; 315/34
See application file for complete search history.

(56) References Cited

U.S. PATENT DOCUMENTS 7,307,391 B2 * 12/2007 Shan ..... 315/291
8,324,817 B2 * 12/2012 Ivey et al. ..... 315/151
8,376,583 B2 * 2/2013 Wang et al. ..... 362/249.05
8,419,223 B2 * 4/2013 Withers ..... 362/294
8,444,292 B2 * 5/2013 Ivey et al. ..... 362/225
8,541,958 B2 * 9/2013 Simon et al. ..... 315/307
8,596,813 B2 * 12/2013 Ivey ..... 362/217.13
8,807,785 B2 * 8/2014 Ivey et al. ..... 362/218
8,901,823 B2 * 12/2014 Scapa et al. ..... 315/131
8,931,933 B2 * 1/2015 Tong et al. ..... 362/373
2002/0114155 A1 * 8/2002 Katogi ..... F21S 2/00 362/219
2005/0162101 A1 * 7/2005 Leong et al. ..... 315/291
2005/0281030 A1 * 12/2005 Leong et al. ..... 362/234
2007/0098384 A1 * 5/2007 Wakamizu ..... G03B 17/04 396/56
2008/0290814 A1 * 11/2008 Leong et al. ..... 315/294
2010/0079075 A1 * 4/2010 Son ..... 315/152
2010/0103664 A1 * 4/2010 Simon ..... F21K 9/135 362/234
2010/0106306 A1 * 4/2010 Simon ..... H05B 33/0854 700/276
2010/0117558 A1 * 5/2010 Lee ..... F21K 9/00 315/294
2010/0176724 A1 * 7/2010 Neal et al. ..... 315/36
2010/0177532 A1 * 7/2010 Simon et al. ..... 362/555
2010/0220469 A1 * 9/2010 Ivey ..... F21K 9/17 362/218
2010/0271802 A1 10/2010 Recker et al.
2012/0002415 A1 * 1/2012 Nelson ..... F21S 2/005 362/235
2012/0008315 A1 * 1/2012 Simon et al. ..... 362/217.13
2012/0014108 A1 * 1/2012 Greenfield ..... F21S 4/008 362/294
2012/0086345 A1 * 4/2012 Tran ..... H05B 37/0272 315/158
2012/0236552 A1 * 9/2012 Leineweber et al. ..... 362/218
2013/0050997 A1 * 2/2013 Bretschneider et al. ..... 362/190

OTHER PUBLICATIONS

Chinese Office Action based on Application No. 201110273883.X(5 Pages and 5 pages of English translation) dated Jul. 14, 2015.

* cited by examiner

LIGHTING DEVICE

RELATED APPLICATIONS

The present application is a national stage entry according to 35 U.S.C. §371 of PCT application No.: PCT/EP2012/065900 filed on Aug. 14, 2012, which claims priority from Chinese application No.: 201110273883.X filed on Sep. 15, 2011, and is incorporated herein by reference in its entirety.

TECHNICAL FIELD

Various embodiments relate to a lighting device.

BACKGROUND

In modern society, the illuminating devices are widely used for illumination, and higher requirements are put on the illuminating devices, for instance, the lamp is required to be capable of being turned on and off automatically and periodically, or capable of providing brightness to different degrees in different application scenes. In particular, it is required to wirelessly control the light to facilitate a remote and short-range operation. Accordingly, in various lighting devices, a wireless circuit and an antenna are especially arranged in a tube light for using a wireless communication protocol and an exterior light control center or a wireless controller to conduct communication so as to receive an instruction.

In the related art, since a metal general shields a wireless signal, a wireless circuit, especially an antenna, cannot be mounted at the place where metal shielding is present. The wireless circuit and antenna are generally placed on a light engine for the reason that a heat sink is made of metal and the cover is made of plastic, such that a wireless signal may pass through the cover. However, it is obvious that there is a disadvantage to do so. With a plurality of LEDs provided above a light engine, some LEDs need to be removed from the light engine in order to mount the wireless circuit and the antenna on the light engine, whereby the wireless circuit is mounted on the position where the LEDs are removed. That is to say, the wireless circuit and the LEDs are arranged side by side on the light engine. Even if the wireless circuit and the antenna do not occupy a lot of space, the tube light still has a dark part, which affects significantly its performance and user's comments thereon.

SUMMARY

Various embodiments provide a novel lighting device. Said device can overcome the defects present in the related art, maintains the profile of a conventional lighting device, is easy to mount, is capable of conducting a good wireless communication, and has a higher brightness.

According to various embodiments, a lighting device includes a tube and end caps located at two ends of the tube, a lighting assembly arranged in the tube, a driver for the lighting assembly, an antenna and a wireless communication circuit for conducting wireless communication, the antenna being provided in the end cap and the wireless communication circuit being provided in the tube or at least partially provided in the end cap, and one side of the wire communication circuit being connected to the driver and the other side thereof being connected to the antenna. Since the antenna for wireless communication is provided advantageously in the end cap, the space on light engine inside the tube is not occupied as compared with the related art. In addition, the wireless communication circuit may be provided in the tube or partially in the end cap for electrically connecting the antenna in the cap end and the driver inside the tube, which ensures that a wireless signal is received using the antenna and transmitted to the driver via the wireless communication circuit, and the lighting assembly is driven by the driver to operate normally. Thus, the manner of connecting via the circuit board in the related art is replaced for controlling directly the working states of the LED driver via the wireless communication circuit. Therefore, more light sources especially LEDs may be arranged on the circuit board, such that the overall brightness of the lighting device is unaffected while realizing a good wireless communication.

Preferably, the wireless communication circuit is formed on a wireless communication circuit board, and the antenna is connected to the wireless communication circuit board, thereby realizing an effective signal transmission between the antenna and the wireless communication circuit board.

Preferably, the LED driver and the wireless communication circuit board are arranged side by side and connected in series. Such a connection manner facilitates assembling, ensures the effect of communication between the LED driver and the wireless communication circuit, and reduces as much as possible communication interruption due to the wire connection.

Preferably, the lighting assembly includes a circuit board and a plurality of LEDs arranged on and at one side of the circuit board. Thus, the LED light source can be provided for realizing energy-efficient illumination.

In a specific embodiment, a heat sink is included, wherein the heat sink is provided on one side of the circuit board facing away from the LED and the LED driver is provided on one side of the heat sink facing away from the circuit board. The heat sink is arranged between the LED driver and the light engine, which not only allows the two to be supported by the heat sink but also enables sufficient use of a limited space so as to mount enough LEDs on the light engine for improving illumination.

Preferably, the tube includes an upper housing and a lower housing mounted together and the upper housing or the lower housing of the housing is designed as a part of the heat sink. The heat dissipating effect is further improved.

Preferably, the end caps are made of plastic, which ensures that the wireless communication signal is not subject to shielding, may reduce manufacturing cost and reduces the weight of the lighting device. Other suitable light-weight materials reducing or eliminating shield may also be taken into consideration for making an end cap.

According to various embodiments, there is provided a lighting device which maintains the profile of a conventional tube lighting devices, is capable of conducting a good wireless communication, is easy to mount, and has a higher brightness.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

The following detailed description refers to the accompanying drawing that show, by way of illustration, specific details and embodiments in which the disclosure may be practiced.

Figure 1:
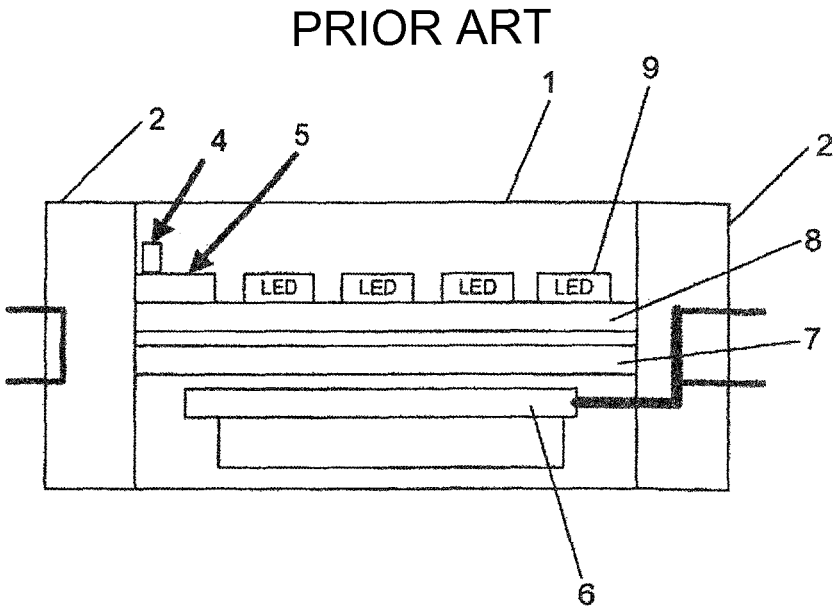
FIG. 1 is a schematic diagram of an internal structure of a tube-shaped lighting device according to the related art.

FIG. 1 is a schematic diagram of an internal structure of a tube-shaped lighting device according to the related art. End caps 2 are located at two ends of a tube 1, respectively, and in the end caps 2 there are large unoccupied structural spaces. A light engine 8, a heat sink 7, and an LED driver 6 are disposed laminatingly layer by layer inside the tube 1. A plurality of LEDs 9 for illumination are provided on the light engine 8. However, on the light engine 8 there are arranged an antenna 4 and a wireless communication circuit 5 for conducting a wireless communication. From the figure, it can be clearly seen that the antenna 4 for receiving a wireless signal and controlling the lighting device and the wireless communication circuit 5 are located on the light engine 8, such that the position where the LEDs are initially arranged is occupied and the brightness of the lighting device is affected.

Figure 2:
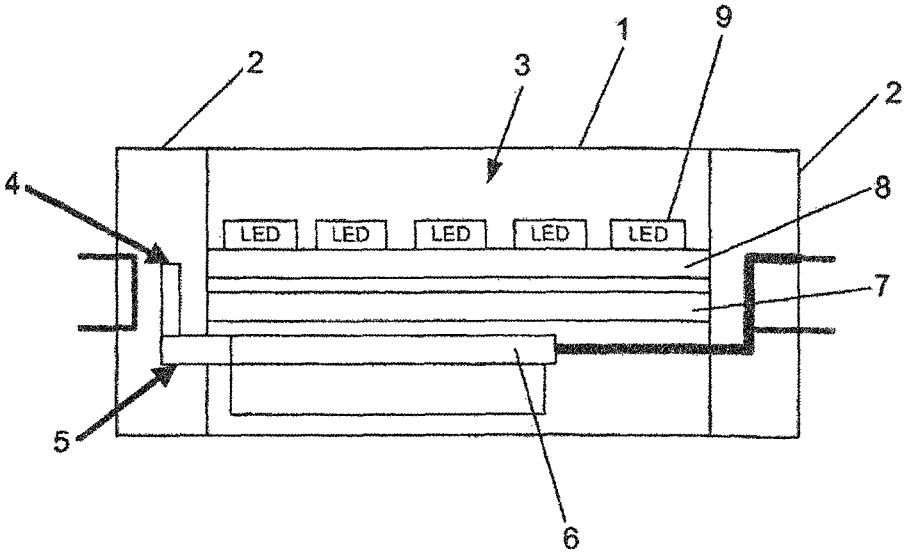
FIG. 2 is a schematic diagram of an internal structure of a lighting device according to a specific embodiment of the present disclosure, wherein the lighting device is designed as a tube shape.

FIG. 2 is a schematic diagram of an internal structure of a lighting device according to a specific embodiment of the present disclosure, wherein the lighting device is designed as a tube shape. It is shown by comparison with FIG. 1 that, in a lighting device also having a tube-shape structure, the antenna 4 for receiving a wireless signal is located in the cap end 2 on one side of the tube 1, the wireless communication circuit 5, designed in the form of a wireless communication circuit board, is partially located in the end cap 2 and partially in the tube 1 for connecting the antenna to the LED driver 6 inside the tube 1 so as to control the lighting device. Herein, the wireless communication circuit board and the LED driver 6 are arranged side by side and connected together. The two are connected directly, whereby assembling may be performed simply, the communication between the LED driver 6 and the wireless communication circuit 5 may be ensured, and communication interruption caused by wire connection or a short circuit due to an unreasonable wire connection may be reduced as much as possible.

In a preferred embodiment, the end caps 2 which are optionally made of a light-weight material such as plastic which not shields a wireless signal and the tube 1 may be connected together, whereby respective components of the end caps 2 and the tube 1 may be assembled conveniently. Similar to what is shown in FIG. 1, the light engine 8, the heat sink 7, and the LED driver 6 are disposed stacked inside the tube 1. Since there is no need to arrange the antenna 4 and the wireless communication circuit 5 inside the tube 1, a plurality of LEDs may be placed over the whole space of the light engine 8 so as to provide sufficient brightness.

Figure 3:
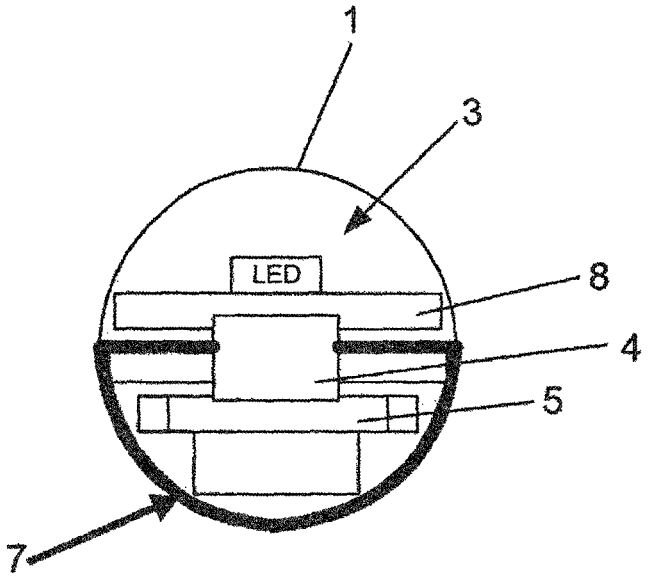
FIG. 3 is a cross-sectional schematic diagram of an end plane of a lighting device according to another embodiment of the present disclosure.

FIG. 3 is a cross-sectional schematic diagram of an end plane of a lighting device according to another embodiment of the present disclosure. In said embodiment, the heat sink 7 designed as a part of the tube 1 has a semicylindrical structure. In order to prevent the heat sink 7 made of a metal material from shielding a wireless signal, the antenna 4 and the wireless communication circuit 5 with one side connected thereto may be wholly placed in the end cap 2. Of course, the wireless communication circuit 5 may be placed partially in the end cap 2 to allow for a more compact design of the lighting device. The other side of the wireless communication circuit 5 is connected to the LED driver 6 inside the tube 1. Since the wireless communication circuit 5 and the LED driver 6 are arranged side by side, the LED driver 6 is not shown in the cross-sectional view of said end plane. The elongated mounting plane of the heat sink 7 goes longitudinally through the whole tube 1 and is located near the center of the tube 1. The LED driver 6 is fixed at one side where the mounting plane faces the arch-shaped structure of the heat sink 7, and the light engine 8 having a plurality of LEDs 9 are fixed to the other side of the mounting plane.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

LIST OF REFERENCE SIGNS

1 tube
2 end cap
3 lighting assembly
4 antenna
5 wireless communication circuit
6 LED driver
7 heat sink
8 light engine

The invention claimed is:

1. A lighting device, comprising:

a tube having an interior and at least one open end;

at least one end cap affixed at the at least one open end of the tube, the at least one end cap having an interior volume defining a space adjacent to or coextensive with the interior of the tube, a lighting assembly arranged in the interior of the tube, a light emitting device (LED) driver for the lighting assembly; wherein the LED driver is arranged in the interior of the tube, an antenna, and a wireless communication circuit for conducting wireless communication, the antenna being provided in the space and the wireless communication circuit being provided in the tube or at least partially provided in the space, and one side of the wireless communication circuit being connected to the driver and the other side thereof being connected to the antenna.

2. The lighting device according to claim 1, wherein the wireless communication circuit is formed on a wireless communication circuit board, and the antenna is connected to the wireless communication circuit wireless communication circuit board.

3. The lighting device according to claim 2, wherein the LED driver and the wireless communication circuit board are arranged side by side and connected in series.

4. The lighting device according to claim 1, wherein the lighting assembly comprises a circuit board and a plurality of LEDs arranged on and at one side of the circuit board.

5. The lighting device according to claim 4, further comprising a heat sink, wherein the heat sink is provided on one side of the circuit board facing away from the LED and the LED driver is provided on one side of the heat sink facing away from the circuit board.

6. The lighting device according to claim 5, wherein the tube comprises an upper housing and a lower housing mounted together and the upper housing or the lower housing of the housing is designed as a part of the heat sink.

7. The lighting device according to claim 1, wherein the end caps are made of plastic.

8. A lighting device, comprising:

a tube and end caps located at two ends of the tube, a lighting assembly arranged in the tube, a light emitting device (LED) driver for the lighting assembly; wherein the LED driver is arranged in the interior of the tube, an antenna disposed substantially completely within one of said end caps, and a wireless communication circuit for conducting wireless communication, the wireless communication circuit being provided in the tube or at least partially provided in the end cap, and one side of the wireless communication circuit being connected to the driver and the other side thereof being connected to the antenna wherein each end cap is integrally affixed to the tube.

9. The lighting device according to claim 1, wherein the LED driver is configured to drive the lighting assembly arranged in the interior of the tube.

* * * * *